US012735230B2

(12) United States Patent
Kerr

(10) Patent No.: US 12,735,230 B2
(45) Date of Patent: Sep. 15, 2026

(54) TRAY WITH LID

(71) Applicant: Laughing Lizard Pty Ltd., Marcus Beach (AU)

(72) Inventor: Georgie Kerr, Marcus Beach (AU)

(73) Assignee: BLB IP Pty Ltd, Brisbane City (AU)

( * ) Notice: Subject to any disclaimer, the term of this patent is extended or adjusted under 35 U.S.C. 154(b) by 0 days.

(21) Appl. No.: 19/052,847

(22) Filed: Feb. 13, 2025

(65) Prior Publication Data

US 2025/0263207 A1 Aug. 21, 2025

Related U.S. Application Data

(60) Provisional application No. 63/553,993, filed on Feb. 15, 2024.

(51) Int. Cl.

| | |
|---|---|
| ***B65D 43/02*** | (2006.01) |
| ***B65D 1/36*** | (2006.01) |
| ***B65D 25/10*** | (2006.01) |
| ***B65D 55/16*** | (2006.01) |
| ***B65D 81/32*** | (2006.01) |

(52) U.S. Cl.

CPC ..... *B65D 43/0218* (2013.01); *B65D 1/36* (2013.01); *B65D 25/10* (2013.01); *B65D 55/16* (2013.01); *B65D 81/3294* (2013.01); *B65D 2251/06* (2013.01); *B65D 2251/1025* (2013.01); *B65D 2251/1058* (2013.01); *B65D 2543/00101* (2013.01); *B65D 2543/00314* (2013.01); *B65D 2543/00833* (2013.01)

(58) Field of Classification Search

CPC ..... B65D 1/36; B65D 81/3294; B65D 81/3834; B65D 2543/00833; B65D 2543/00314; B65D 2543/00101; B65D 2251/1058; B65D 2251/1025; B65D 2251/1016; B65D 45/22; B65D 45/18; B65D 43/0212; B65D 43/0218; A45C 11/20

USPC ..... 220/526

See application file for complete search history.

(56) References Cited

U.S. PATENT DOCUMENTS

| | | | | |
|---|---|---|---|---|
| 3,487,972 A * | 1/1970 | Swett | ..... | B65D 43/0218 220/555 |
| 6,415,947 B1 * | 7/2002 | Kim | ..... | B65D 43/0218 220/326 |
| 7,114,630 B2 * | 10/2006 | Dege | ..... | B65D 43/0212 220/523 |

(Continued)

*Primary Examiner* — Nathan J Jenness
*Assistant Examiner* — Jennifer Castriotta
(74) *Attorney, Agent, or Firm* — Eric Karich; Karich & Associates

(57) ABSTRACT

A tray with lid has a bottom tray with a plurality of compartments, each having a bottom surface and upwardly extending sidewalls that extend to a perimeter opening. A top surface joins the compartments and extends to a perimeter edge that forms an outer ledge surrounding the compartments. A top lid has a generally planar body with a top surface and a bottom surface that extend to a perimeter edge adapted to fit over the ledge. The top lid includes a rigid plate in the form of a sheet body sized to fit over the bottom tray, the sheet body having cutouts. The rigid plate is molded within a resilient outer covering of the top lid, such that only the resilient outer covering extends over the cutouts, creating recessed portions. The rigid plate is made of steel and the resilient outer covering is made of silicone.

9 Claims, 3 Drawing Sheets

(56) References Cited

U.S. PATENT DOCUMENTS

| | | | | |
|---|---|---|---|---|
| 7,255,228 | B2 * | 8/2007 | Kim | A45C 11/00 206/320 |
| 8,376,177 | B2 * | 2/2013 | Castner | B65D 45/00 206/561 |
| 10,494,143 | B2 * | 12/2019 | Kuo | B65D 1/36 |
| 10,583,953 | B2 * | 3/2020 | Vazzano | B65D 1/24 |
| D1,070,530 | S * | 4/2025 | Qin | D7/703 |
| 12,297,005 | B2 * | 5/2025 | Bontrager | B65D 43/0218 |
| 2006/0201950 | A1 * | 9/2006 | Liu | B65D 1/36 220/521 |
| 2008/0110911 | A1 * | 5/2008 | Chen | B65D 45/32 220/793 |
| 2009/0200195 | A1 * | 8/2009 | Kovacevich | B65D 1/36 220/780 |

* cited by examiner

TRAY WITH LID

CROSS-REFERENCE TO RELATED APPLICATIONS

This application for a utility patent claims the benefit of U.S. Provisional Application No. 63/553,993, filed Feb. 15, 2024.

BACKGROUND OF THE INVENTION

Field of the Invention

This invention relates generally to storage trays, and more particularly to a foodsafe tray having a sealable lid and removable fasteners.

Description of Related Art

Food trays with compartments are well known in the prior art, often manufactured for transportable meals and for buffet-style serving facilities (lunchrooms, food courts, cafeterias, etc.). These products do not typically include lids or covers, but closable lunchboxes sometimes include dividers to form compartments.

In most cases, containers that include sealable lids/covers require a degree of manual force to remove that may be beyond the abilities of those with certain disabilities, or the very young or elderly. However, covers that are easier to manipulate tend to form no seal, or a weak seal that cannot contain liquids or help maintain a desired temperature. Prior art rigid container trays often have edges and irregularities that create issues with safety, and also make the compartments more difficult to clean.

The prior art teaches food trays with lids. However, the prior art does not teach a food tray that is both sealable and suitable for use by most ages and abilities. The present invention fulfills these needs and provides further advantages as described in the following summary.

SUMMARY OF THE INVENTION

The present invention teaches certain benefits in construction and use which give rise to the objectives described below.

The present invention provides a tray with lid comprising a bottom tray and a top lid. The bottom tray includes a plurality of compartments each having a bottom surface and upwardly extending sidewalls that extend upwardly from the bottom surface to a perimeter opening. A top surface of the bottom tray joins the plurality of compartments together and extends to a perimeter edge that extends outwardly past the outermost upwardly extending sidewalls to form an outer ledge that surrounds the plurality of compartments. The top lid comprises a generally planar sheet body having a top surface and a bottom surface that extend to a perimeter edge adapted to fit over the ledge of the bottom tray. The top lid further includes a rigid plate in the form of a sheet body having an outer perimeter that is sized and shaped to fit over the bottom tray, wherein the sheet body includes cutouts that form recessed portions of the top lid. The rigid plate is molded within a resilient outer covering of the top lid, such that only the resilient outer covering extends over the recessed portions.

A primary objective of the present invention is to provide a tray with lid having advantages not taught by the prior art.

Another objective is to provide a tray with lid that includes a bottom tray and a top lid that are adapted to form a seal, while still being easy to separate A further objective is to provide a tray with lid chamfered/rounded edges, and soft materials, for enhanced safety.

A further objective is to provide a tray with lid wherein the lid is completely removable from the tray, which assists with cleaning.

A further still objective is to provide a tray with lid wherein the tray can be accessed while the lid is still attached on one side.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a tray with lid for containing food, or for other uses such as organizing tools/accessories/crafts/etc.

Figure 1:
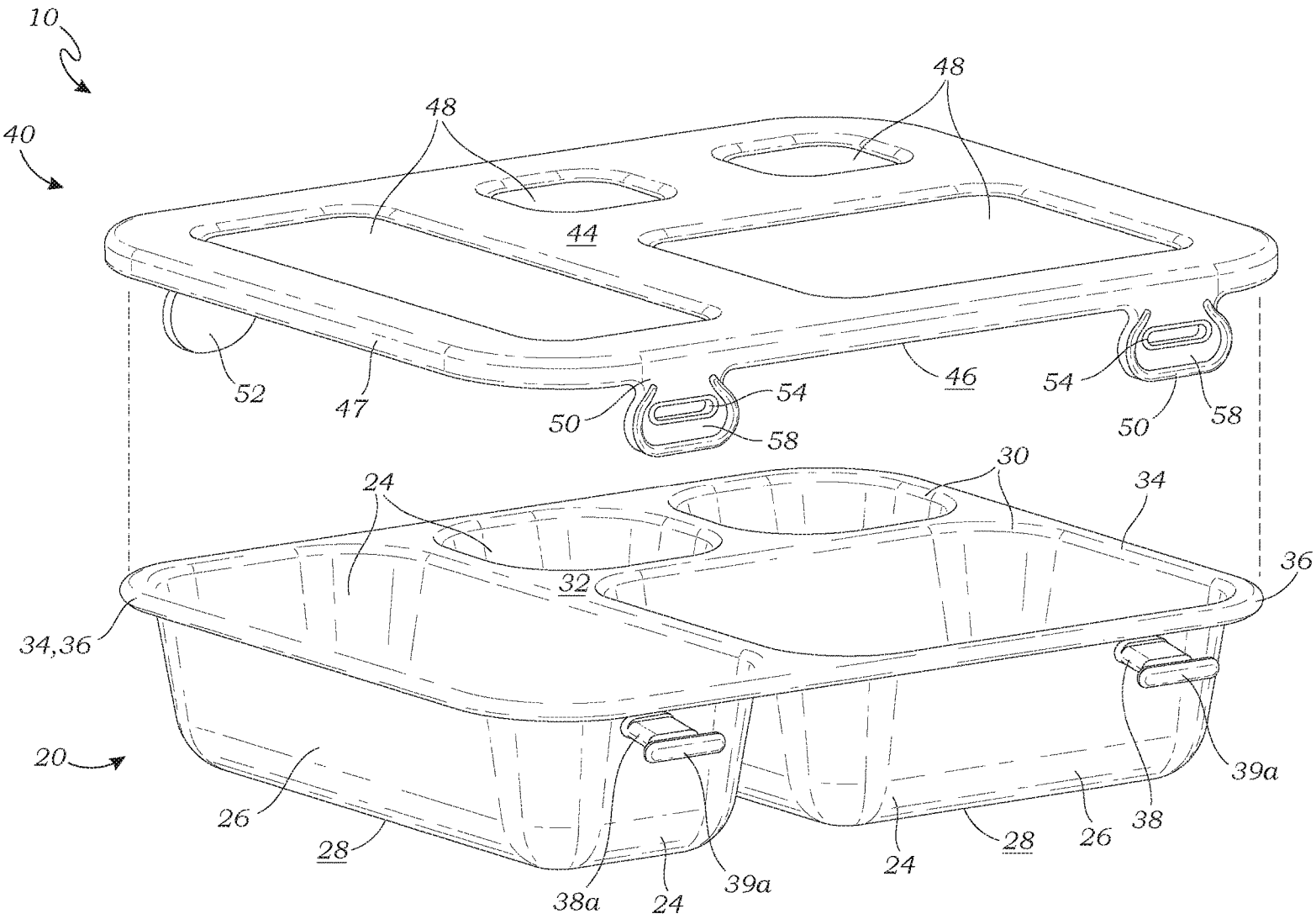
FIG. 1 is an exploded perspective view of a tray with lid that includes a bottom tray and a top lid, according to one embodiment of the present invention.
Figure 2:
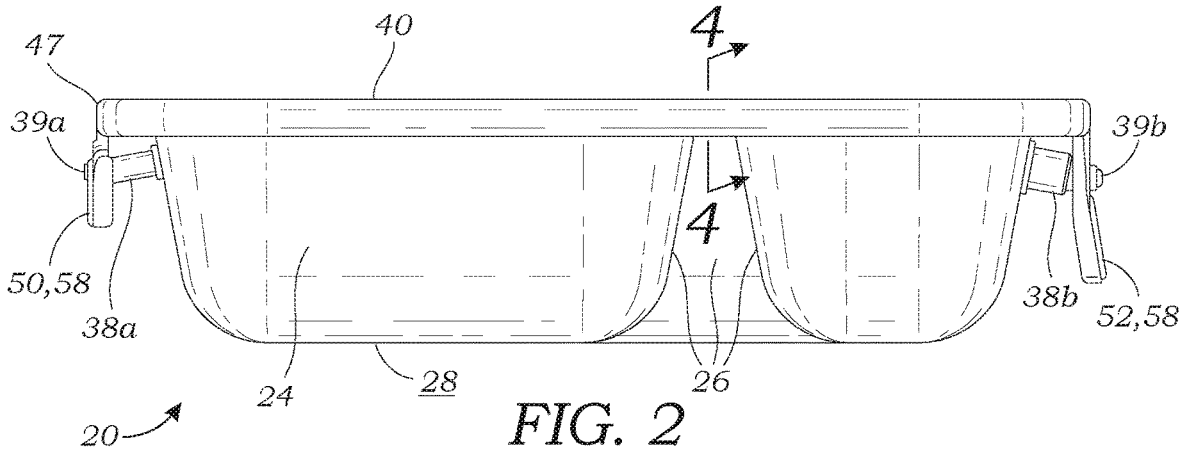
FIG. 2 is a side elevational view of the tray with lid once it has been assembled.

FIG. 1 is an exploded perspective view of a tray with lid 10 according to one embodiment of the present invention. FIG. 2 is a side elevational view thereof. As shown in FIGS. 1-2, the tray with lid 10 comprises a bottom tray 20 and a top lid 40. In this embodiment, the bottom tray 20 comprises a plurality of compartments 24 each having a bottom surface 28 and upwardly extending sidewalls 26 that extend upwardly from the bottom surface 28 to a perimeter opening 30. The perimeter openings 30 are connected to each other by a top surface 32 of the bottom tray 20. In some embodiments, the perimeter openings 30 may be chamfered so that there is no hard edge. The top surface 32 joins the plurality of compartments 24 together and extends to a perimeter edge 34, and, in this embodiment, the perimeter edge 34 extends outwardly past the outermost upwardly extending sidewalls 26 to form an outer ledge 36 that surrounds the plurality of compartments 24. In this embodiment, the perimeter edge 34 is in a generally rectangular shape, but any suitable top plan shape may be formed, as long as it is compatible with the invention.

In this embodiment, the plurality of compartments 24 are in the form of four generally rectangular compartments of different sizes, for holding different types of food/other items. Furthermore, the compartments 24 may be rounded, which may help with ease of cleaning or scooping. However, any number of compartments may be implemented, in any suitable shape, which should be considered within the scope of the present invention. In some embodiments, at least some of the compartments 24 may also be joined together via a channel or similar structure formed in the upwardly extending sidewalls 26 or top surface 32 (not shown), rather than separated by the sidewalls 26 and top surface 32.

The bottom tray 20 may be constructed of a rigid material like stainless steel, and the top lid 40 is constructed at least partially of a resilient material such as silicone, although obviously other materials may be used if desired by one skilled in the art. The tray with lid 10 is durable, washable, and foodsafe. The bottom tray 20 may be deburred so that there are no sharp edges. The silicone lid is particularly suitable for young children or those with motor disabilities. However, similar materials may be used.

The top lid 40 attaches to the bottom tray 20 at a plurality of attachment points 38, so that the top lid 40 can be secured to close the bottom tray 20, or removed to access the contents, or for cleaning. The plurality of attachment points 38 of the present embodiment are positioned on the outermost sidewalls 26 of the bottom tray 20. In this embodiment, the attachment points 38 are in the form of first and second pairs of protrusions 38 each having a securing endpiece 39, the pairs being formed on opposite sides of the bottom tray 20 (best shown in FIG. 2). As shown in the drawings, the attachment points 38 may each have a base that is wider than the rest of the attachment point, which may assist with welding/otherwise fixing to the tray 20. In this embodiment, each pair is spaced a distance apart and positioned adjacent the ledge 36, and further angles slightly downwardly, though in some embodiments may protrude at any suitable angle. In this embodiment, the securing endpieces 39 of the first pair of protrusions 38*a* are each in the form of a laterally extending tab 39*a*, and the securing endpieces 39 of the second pair of protrusions 38*b* are each in the form of a rounded head 39*b* (i.e., as in a pinhead or head of a screw), wherein the securing endpieces 39 engage with the top lid 40, discussed in further detail below. While one example of the attachment points 38 is illustrated and described, any similar form of attachment point may be constructed, as deemed suitable by the manufacturer.

As illustrated, the top lid 40 comprises a generally planar sheet body having a top surface 44 and a bottom surface 46 that extend to a perimeter edge 47. The sheet body 60 is complimentary to the top surface 32 of the bottom tray 20, wherein the perimeter edge 47 of the top lid 40 is adapted to fit over the ledge 36 of the bottom tray 20. In this embodiment, the top surface 44 of the top lid 40 includes a plurality of recessed portions 48 that contour and are shaped to match the shape of the perimeter openings 30 of the plurality of compartments 24. However, in other embodiments, the top surface 44 may be generally smooth. As shown in FIGS. 1-2, the perimeter edge 47 of the top lid 40 includes a first pair of downwardly extending tabs 50, and a second pair of downwardly extending tabs 52 on the opposite side, wherein each pair 50 and 52 is positioned to align with the attachment points 38 of the bottom tray 20. In this embodiment, the first pair of downwardly extending tabs 50 each include a laterally extending aperture 54 that is shorter than the laterally extending tabs 39*a* of the first pair of protrusions 38*a*, so that the laterally extending tabs 39*a* can pass through the laterally extending apertures 54 and secure the first pair of downwardly extending tabs 50 on the first pair of protrusions 38*a*. Similarly, the second pair of downwardly extending tabs 52 may each include an aperture 55 that is sized and adapted to receive the rounded head 39*b* of the second pair of protrusions 38*b*, best shown in FIG. 5 and discussed further below. As illustrated, in various embodiments, the apertures 54 and 55 may each include reinforcement material surrounding the aperture, which may help reduce the possibility of tearing or unwanted stretching.

Figure 3:
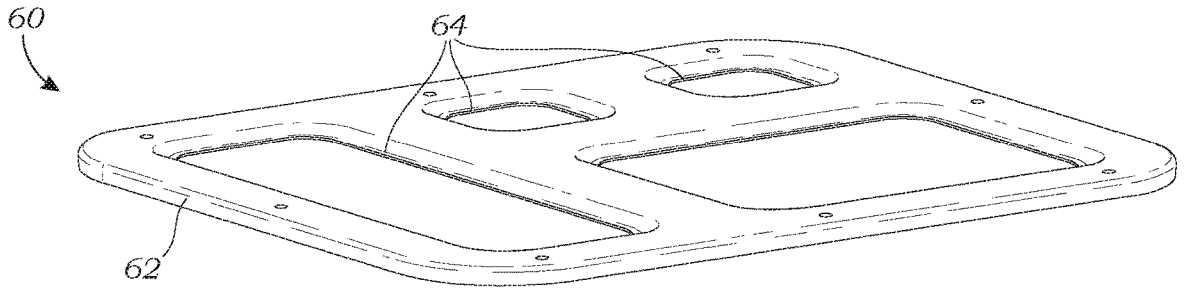
FIG. 3 is a perspective view of a rigid plate of the top lid.

FIG. 3 is a perspective view of a rigid plate 60 of the top lid 40 of the tray with lid 10. As shown in FIG. 3, in some embodiments, the top lid 40 includes the rigid plate 60 in the center of the top lid 40 which provides rigidity. The rigid plate 60 may be in the form of a sheet body having an outer perimeter 62 that is sized and adapted to fit over the bottom tray 20. The sheet body 60 may include cutouts 64 that are shaped to align with the recessed portions 48 of the top lid 40. The rigid plate 60 may be molded within a silicone outer covering of the top lid 40. In some embodiments, the rigid plate 60 may be constructed of metal, but other rigid materials may also be used (e.g., rigid plastics, etc.).

Figure 4:
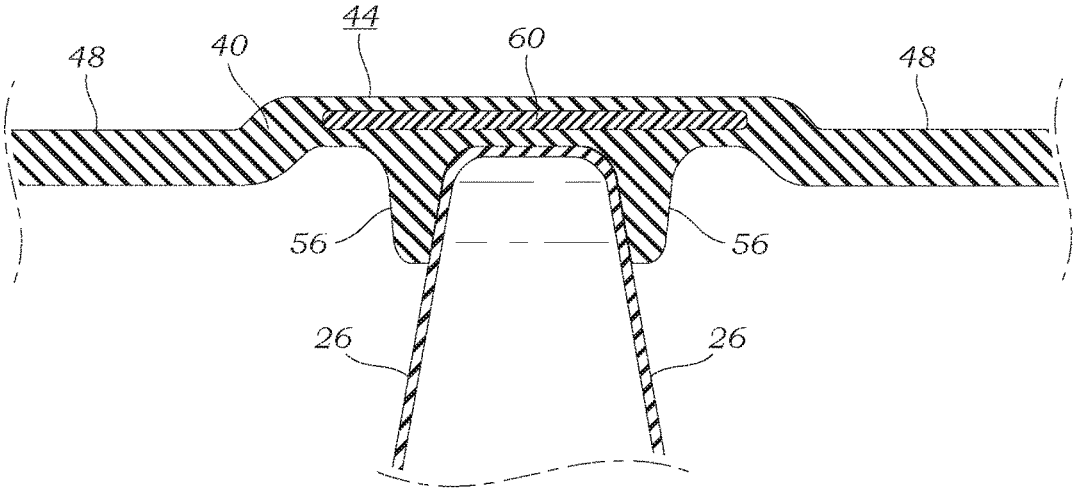
FIG. 4 is a sectional view of the tray with lid taken along line 4-4 in FIG. 2.

FIG. 4 is a sectional view of the tray with lid taken along line 4-4 in FIG. 2. As shown in FIG. 4, the bottom surface 46 of the top lid 40 may include sealing portions 56 that align with the perimeter openings 30 of the plurality of compartments 24, so that when the top lid 40 is installed, the plurality of compartments 24 are sealed. The silicone outer surface provides a soft, pleasant, easy to grip surface, while the rigid plate 60 provides weight and structure for enhancing the seal. For the purposes of this application, the term "seal" is defined to mean a seal that is capable of substantially containing most materials including granular materials, liquids, creams/gels, etc, but is not necessarily a perfect hermetic seal.

Figure 5:
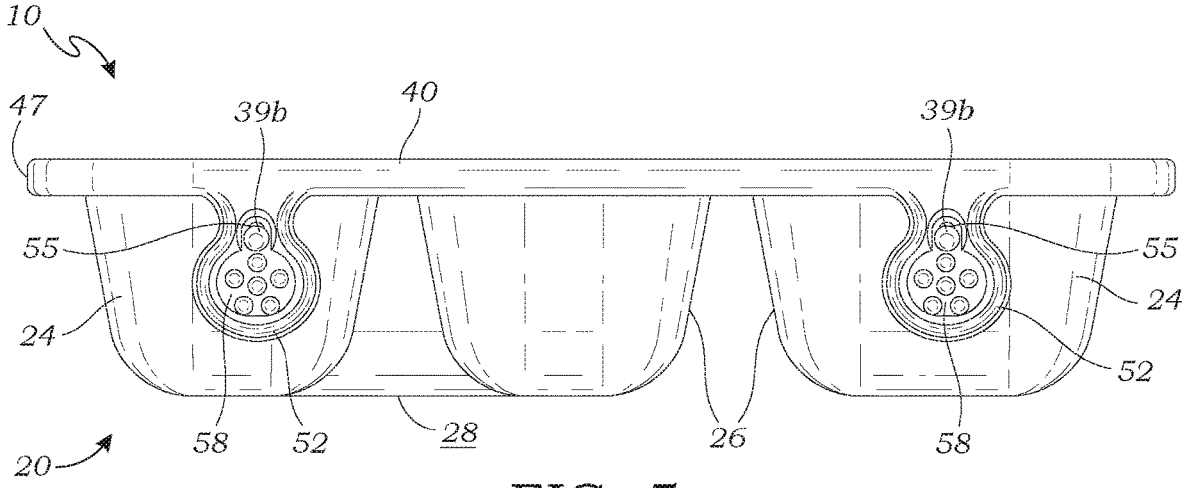
FIG. 5 is a side elevational view thereof, showing a grip portion of a pair of downwardly extending tabs.

FIG. 5 is a side elevational view of the tray with lid 10, showing a grip portion 58 of the second pair of downwardly extending tabs 52. As shown in FIGS. 1-2 and 5, the first and second pairs of downwardly extending tabs 50 and 52 each further include the grip portion 58 beneath the respective apertures for a user to grip to secure or remove the tabs 50 and 52 onto the bottom tray 20. As shown in FIG. 5, the grip portion 58 of the second pair of tabs 52 is larger than the grip portion 58 of the first pair of tabs 50, and further has a textured surface for gripping.

Figure 6:
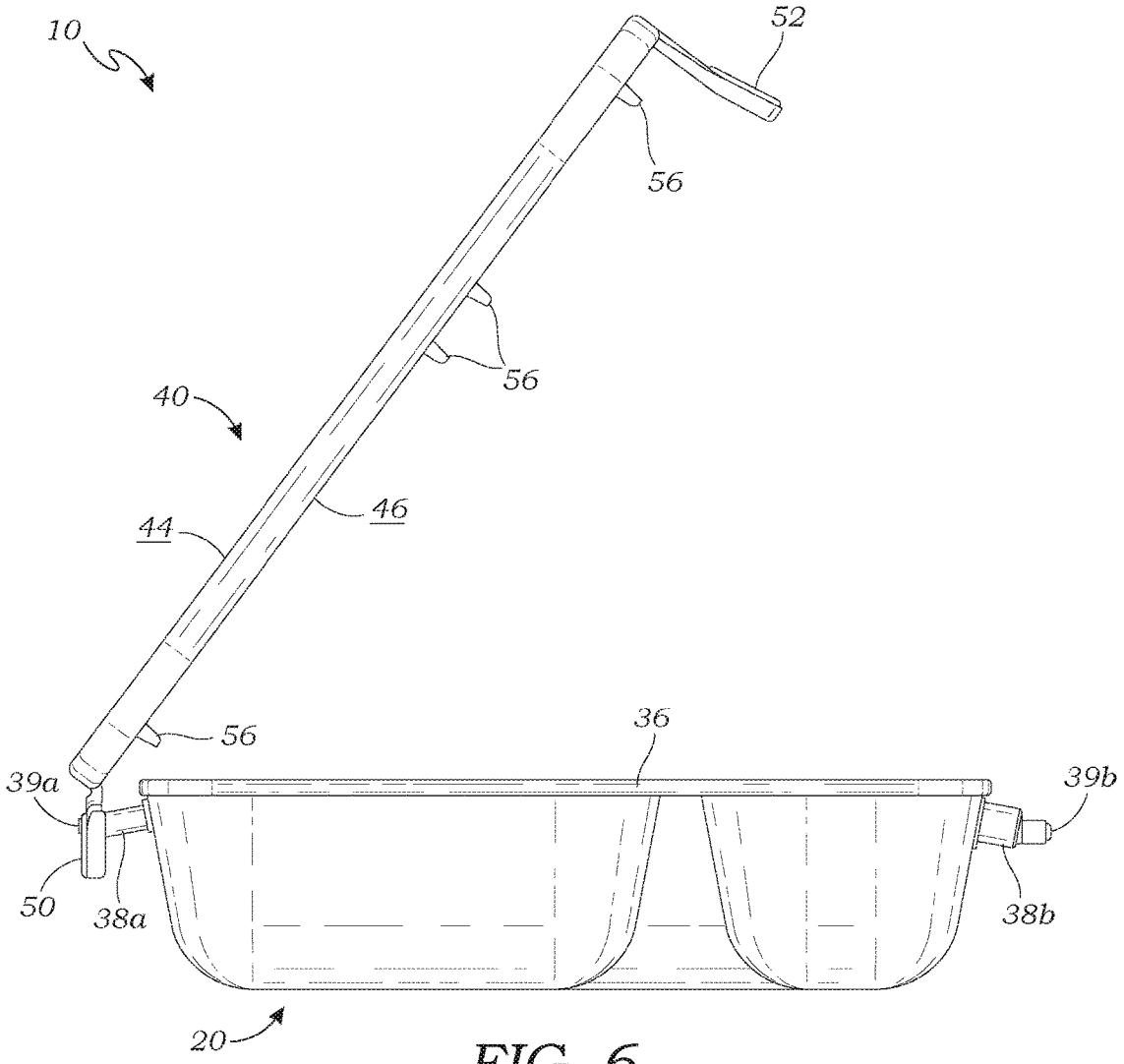
FIG. 6 is a side elevational view thereof, showing the top lid in an open position.

FIG. 6 is a side elevational view of the tray with lid 10, showing the top lid 40 in an open position. As shown in FIG. 6, in use, the top lid 40 may be fully covering the plurality of compartments 24, or it may be attached on only one side, wherein the downwardly extending tabs 50 or 52 that are attached can be bent so that the top lid 40 is not covering the plurality of compartments 24 while remaining attached to the bottom tray 20. Furthermore, the top lid 40 may be detached from the bottom tray 20 entirely. The flexible material of the top lid 40 may allow the apertures to stretch slightly, and further allows the tabs 50 or 52 to flex for gripping, bending, and pulling.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced items unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A tray with lid comprising:

a bottom tray comprising a plurality of compartments each having a bottom surface and upwardly extending sidewalls that extend upwardly from the bottom surface to a perimeter opening;

a top surface of the bottom tray that joins the plurality of compartments together and extends to a perimeter edge that extends outwardly past the outermost upwardly extending sidewalls to form an outer ledge that surrounds the plurality of compartments;

a top lid comprising a generally planar sheet body having a top surface and a bottom surface that extend to a perimeter edge adapted to fit over the ledge of the bottom tray;

wherein the top lid includes a rigid plate in the form of a sheet body having an outer perimeter that is sized and shaped to fit over the bottom tray, wherein the sheet body includes cutouts; and wherein the rigid plate is molded within a resilient outer covering of the top lid, such that only the resilient outer covering extends over the cutouts, creating recessed portions; and wherein the rigid plate is made of steel, and the resilient outer covering is made of silicone.

2. The tray with lid of claim 1, further comprising:

first and second pairs of protrusions each having a securing endpiece and being formed opposite one another on the outermost sidewalls of the bottom tray; and wherein the securing endpieces engage downwardly extending tabs that extend downwardly from the perimeter edge of the top lid.

3. The tray with lid of claim 2, wherein each of the downwardly extending tabs includes an aperture for receiving a respective one of the securing endpieces, and reinforcement material surrounding the aperture.

4. The tray with lid of claim 3, wherein each of the downwardly extending tabs further includes a grip portion beneath the aperture for a user to grip, and at least one of the grip portions includes a textured surface.

5. The tray with lid of claim 1, wherein the plurality of compartments comprises four generally rectangular compartments of different sizes.

6. The tray with lid of claim 1, wherein the perimeter opening of each of the plurality of compartments is chamfered, and each of the plurality of compartments is rounded.

7. The tray with lid of claim 1, wherein the bottom tray is constructed of stainless steel and is deburred.

8. The tray with lid of claim 1, wherein the bottom surface of the top lid includes sealing portions that align with the perimeter opening of each of the plurality of compartments, such that when the top lid is positioned over the bottom tray, the plurality of compartments are sealed.

9. The tray with lid of claim 1, wherein the recessed portions contour and are shaped to match a shape of the perimeter opening of each of the plurality of compartments.

* * * * *